US011178968B2

(12) United States Patent
Orsini

(10) Patent No.: US 11,178,968 B2
(45) Date of Patent: Nov. 23, 2021

(54) DRAWER DRESSER AND DRAWER CABINET WITH STABILIZATION DEVICE

(71) Applicant: Jean-Francois Orsini, Washington, DC (US)

(72) Inventor: Jean-Francois Orsini, Washington, DC (US)

( * ) Notice: Subject to any disclaimer, the term of this patent is extended or adjusted under 35 U.S.C. 154(b) by 298 days.

(21) Appl. No.: 16/752,476

(22) Filed: Jan. 24, 2020

(65) Prior Publication Data

US 2021/0227976 A1 Jul. 29, 2021

(51) Int. Cl.
*A47B 96/00* (2006.01)
*A47B 97/00* (2006.01)

(52) U.S. Cl.
CPC ..... *A47B 96/00* (2013.01); *A47B 97/00* (2013.01); *A47B 2097/008* (2013.01)

(58) Field of Classification Search
CPC ..... A47B 96/00; A47B 97/00
USPC ..... 312/319.4, 215, 216, 351.1
See application file for complete search history.

(56) References Cited

U.S. PATENT DOCUMENTS 450,925 A * 4/1891 Beck
1,238,514 A * 8/1917 HartBeck ..... E05B 65/466 312/319.4
3,713,719 A * 1/1973 Detterbeck ..... F24C 15/083 312/352
3,744,867 A * 7/1973 Shaw ..... A61J 7/04 312/234
3,857,619 A * 12/1974 Adickes ..... A47B 77/00 312/107
4,438,606 A * 3/1984 Chardon ..... E04H 1/1238 109/50
4,822,119 A * 4/1989 Compton ..... A47B 49/002 312/326
4,901,651 A * 2/1990 Herron ..... E05G 1/00 109/54
5,028,099 A * 7/1991 Bertucco ..... B65F 1/006 100/34
5,289,783 A * 3/1994 Karl ..... A47B 7/00 83/313

(Continued)

FOREIGN PATENT DOCUMENTS

AU 2014203321 * 1/2015 ..... A47B 63/00
WO WO 2018065075 * 4/2018 ..... G07F 17/00

OTHER PUBLICATIONS

Sam Henderson, "How to Turn a Flip-Front File Cabinet into a Stylish Dresser", Oct. 2018, DIY Network, 1 page, https://www.diynetwork.com/how-to/make-and-decorate/decorating/how-to-make-a-file-cabinet-dresser.*

(Continued)

*Primary Examiner* — James O Hansen
(74) *Attorney, Agent, or Firm* — Chen-Chi Lin

(57) ABSTRACT

A furniture assembly comprises two or more drawers and a plurality of pouches disposed at a rear lower portion of the furniture assembly. The plurality of pouches are filled with water, sand, or dirt. The water may contain a plurality drops of bleach. A minimum weight of the plurality of pouches is determined from torque balance of forces and weights. In one example, the plurality of pouches are disposed at a rear portion of a lower drawer. A rear wall of the plurality of pouches directly contacts a rear wall of the lower drawer. A top surface of each of the plurality of pouches and a top surface of a rear wall of the lower drawer are coplanar.

17 Claims, 6 Drawing Sheets

(56) References Cited

U.S. PATENT DOCUMENTS 5,644,873 A * 7/1997 Bourgault ..... E04H 4/144 52/169.7
6,039,473 A * 3/2000 Bond ..... B42F 15/04 190/120
6,220,562 B1 4/2001 Konkle
6,726,296 B2 * 4/2004 McGilton ..... A47B 77/06 312/228
2003/0001979 A1 * 1/2003 Lowe ..... A47B 81/06 348/836
2005/0023942 A1 * 2/2005 Kunanantakul ..... A47B 67/04 312/221
2005/0242691 A1 * 11/2005 Yang ..... A47B 88/57 312/333
2009/0236955 A1 * 9/2009 Perrin ..... B42F 15/0064 312/184
2013/0127228 A1 * 5/2013 Colvin ..... A47C 1/14 297/452.65
2015/0201755 A1 * 7/2015 Moon ..... A47B 47/0075 211/153
2016/0037928 A1 * 2/2016 Cali, Sr. ..... A47C 5/12 297/135
2016/0089303 A1 * 3/2016 Latorraca ..... G07F 11/62 312/209
2016/0135590 A1 * 5/2016 Zaccai ..... A47B 13/023 312/330.1

OTHER PUBLICATIONS https://www.epa.gov/ground-water-and-drinking-water/emergency-disinfection-drinking-water.
https://smartbottleinc.com/.
https://www.amazon.com/Repair-Drawer-x4-Buckled-Drawers/dp/B07842J3M3/ref=sr_1_1?keywords=drawer+doctor+kit&qid=1579488639&sr=8-1.
https://www.consumerreports.org/furniture/furniture-anchors-not-an-easy-fix-as-child-tip-over-deaths-persist/.

* cited by examiner

DRAWER DRESSER AND DRAWER CABINET WITH STABILIZATION DEVICE

CROSS-REFERENCE TO RELATED APPLICATIONS

The disclosure made in the U.S. Pat. No. 6,220,562 to Konkle is hereby incorporated by reference.

FIELD OF THE INVENTION

This invention relates generally to a furniture assembly having a stabilization device. More particularly, the present invention relates to the furniture assembly having a plurality of pouches filled with water, sand, or dirt.

BACKGROUND OF THE INVENTION

U.S. Pat. No. 6,220,562 to Konkle discloses a furniture tipping restraint comprising an anchor attachable to a wall. However, furniture anchors are not easy fixes, as child tip-over deaths persist (see "Consumer Reports" of the Information Disclosure Statement submitted on Jan. 24, 2020).

In the present disclosure, a plurality of pouches are disposed at a rear lower portion of the furniture assembly. The furniture assembly may be a drawer dresser, a drawer cabinet, a chest of drawers, or an office file cabinet.

SUMMARY OF THE INVENTION

The present invention discloses a furniture assembly comprising two or more drawers and a plurality of pouches disposed at a rear lower portion of the furniture assembly. The plurality of pouches are filled with water, sand, or dirt. The water may contain a plurality drops of bleach. A minimum weight of the plurality of pouches is determined from torque balance of forces and weights.

In one example, the plurality of pouches are disposed at a rear portion of a lower drawer. A rear wall of the plurality of pouches directly contacts a rear wall of the lower drawer. A top surface of each of the plurality of pouches and a top surface of a rear wall of the lower drawer are coplanar.

DETAILED DESCRIPTION OF THE INVENTION

Figure 1:
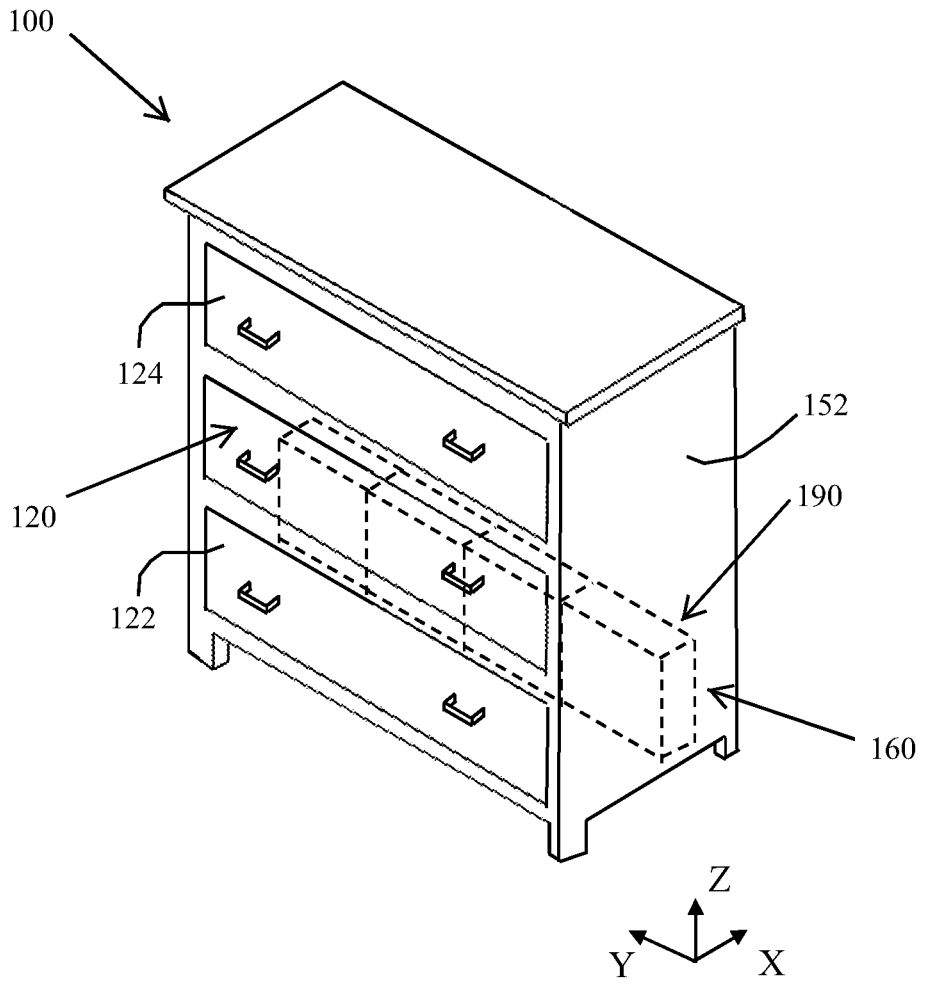
FIG. 1 is a perspective view of a furniture assembly with a plurality of pouches in examples of the present disclosure.

FIG. 1 is a perspective view of a furniture assembly 100 in examples of the present disclosure. In one example, the furniture assembly 100 is a drawer dresser. In another example, the furniture assembly 100 is a drawer cabinet. In still another example, the furniture assembly 100 is a chest of drawers. In yet still another example, the furniture assembly 100 is an office file cabinet. The furniture assembly 100 comprises two or more drawers 120 and a plurality of pouches 160. The two or more drawers 120 comprises a lower drawer 122 and an upper drawer 124. Although three drawers are shown in FIG. 1, the number of drawers may vary.

In examples of the present disclosure, the plurality of pouches 160 are disposed at a rear lower portion 190 of the furniture assembly 100. In examples of the present disclosure, the rear lower portion 190 is of a rectangular prism shape. A length (along X-direction) of the rectangular prism shape is in a range from 5% to 50% of a length of the upper drawer 124. A width (along Y-direction) of the rectangular prism shape is in a range from 70% to 100% of a width of an internal cavity of the furniture assembly 100. A height (along Z-direction) of the rectangular prism shape is in a range from 70% to 100% of a height of the lower drawer 122. Although fours pouches are shown in FIG. 1, the number of pouches may vary.

In examples of the present disclosure, the plurality of pouches 160 directly contact an inner side of a side wall of the lower drawer 122 or an inner side of a side wall 152 of the furniture assembly 100.

In examples of the present disclosure, the plurality of pouches 160 are filled with water, sand, or dirt. The water contains a plurality drops of bleach (See "Disinfect water using household bleach" of United States Environmental Protection Agency website listed in the Information Disclosure Statement submitted on Jan. 24, 2020).

In examples of the present disclosure, the plurality of pouches 160 are aligned along a line (in Y-direction). Each of the plurality of pouches 160 is directly connected to a respective adjacent pouch of the plurality of pouches 160. A sum of a width of each of the plurality of pouches 160 equals to a width of an internal cavity of the furniture assembly 100.

In examples of the present disclosure, the plurality of pouches 160 consists a single pouch. A width of the single pouch equals to a width of an internal cavity of the furniture assembly 100.

In one example, each of the plurality of pouches 160 is of a rectangular prism shape. In another example, each of the plurality of pouches 160 is a smart bottle commercially available from the website of KRW Packaging Machinery, Inc. listed in the Information Disclosure Statement submitted on Jan. 24, 2020).

In examples of the present disclosure, the plurality of pouches 160 are made of a plastic material.

Figure 2:
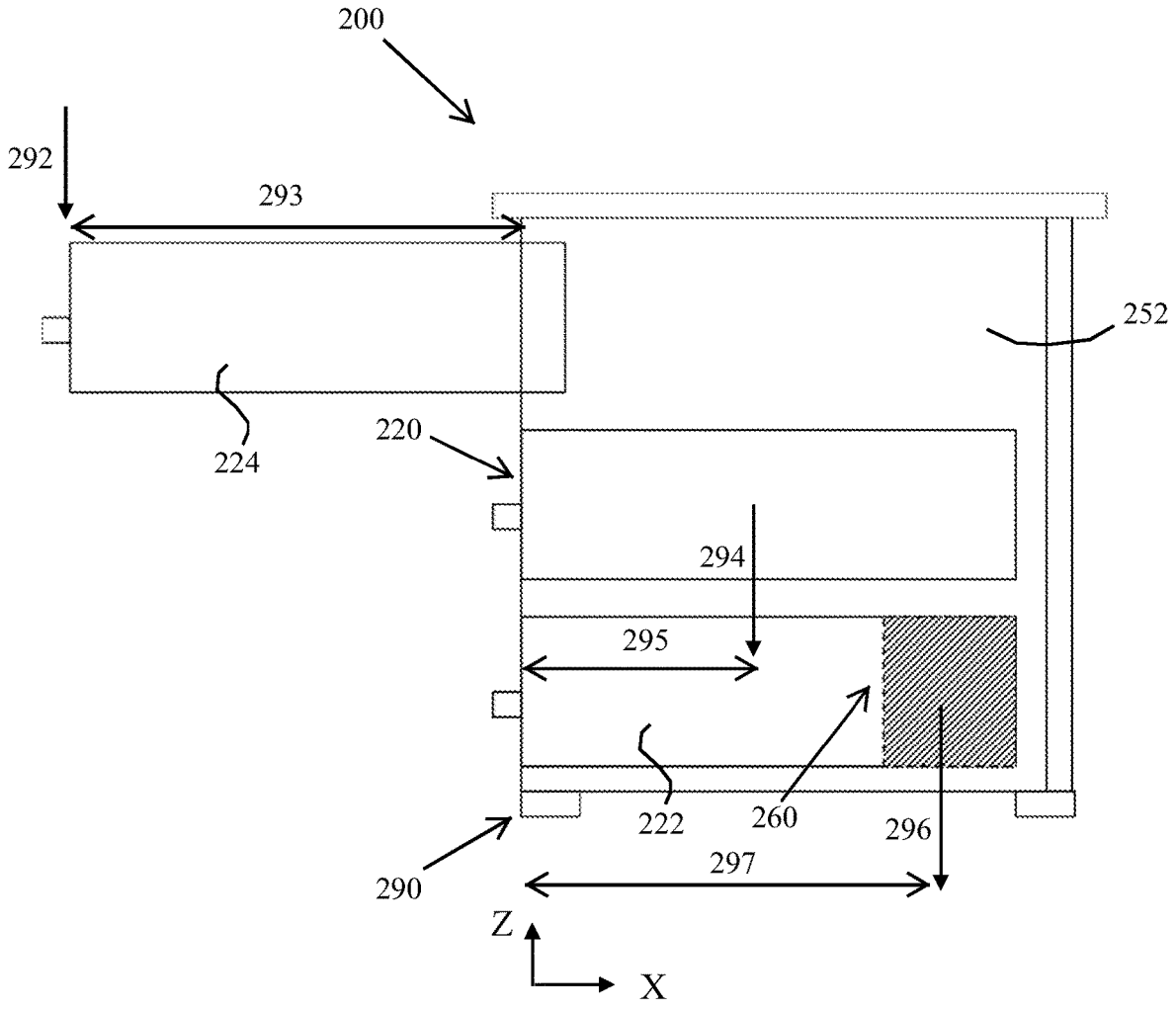
FIG. 2 is a side view of another furniture assembly with an upper drawer in an open condition in examples of the present disclosure.

FIG. 2 is a side view of another furniture assembly 200 in examples of the present disclosure. For clarification, a side wall 252 is shown in transparent so that two or more drawers 220 are visible from a side view. The furniture assembly 200 comprises two or more drawers 220 and a plurality of pouches 260. The two or more drawers 220 comprises a lower drawer 222 and an upper drawer 224. The upper drawer 224 is in an open condition. Without the plurality of pouches 260, if a force 292 is applied to a tip of the upper drawer 224 in an open condition, the furniture assembly 200 may tilt and rotate along a pivot line 290. A minimum weight of the plurality of pouches 260 is determined from torque balance that the force 292 times the distance 293 equals a sum of the weight 294 of the furniture assembly 200 (without the plurality of pouches 260) times the distance 295 and the weight 296 of the plurality of pouches 260 times the distance 297. In examples of the present disclosure, a safety factor is introduced to the force 292 times the distance 293 of torque balance above. In examples of the present disclosure, the safety factor is in a range from 1.5 to 2.5. In one example, the force 292 is an average weight of a toddler. In another example, the force 292 is in a range from 30 pounds to 70 pounds.

In one example, three pouches of water, each weighing 19 pounds (2.3 gallons), are placed in a rear lower portion of a 60-inch by 20-inch by 30 inch drawer dresser.

Figure 6:
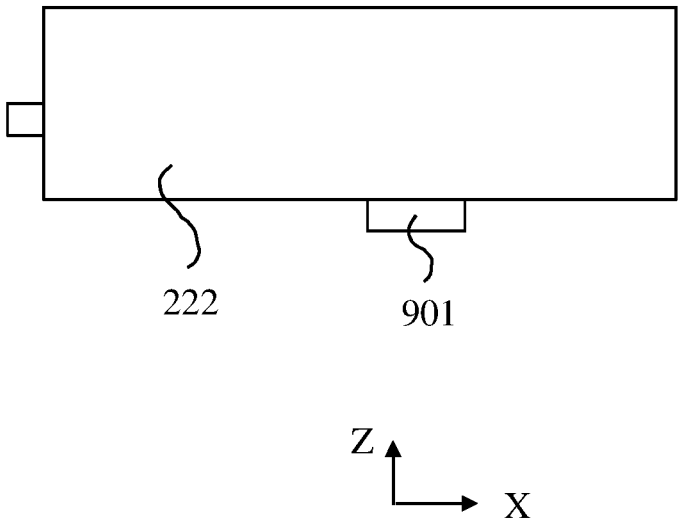
FIG. 6 is a side view of a drawer reinforced by a bracket in examples of the present disclosure.

In examples of the present disclosure, the lower drawer 222 is reinforced by a bracket 901 of FIG. 6 (for example, a Drawer Doctor Kit commercially available at the website listed in the Information Disclosure Statement submitted on Jan. 24, 2020) so as to bear the weight of water.

Figure 3:
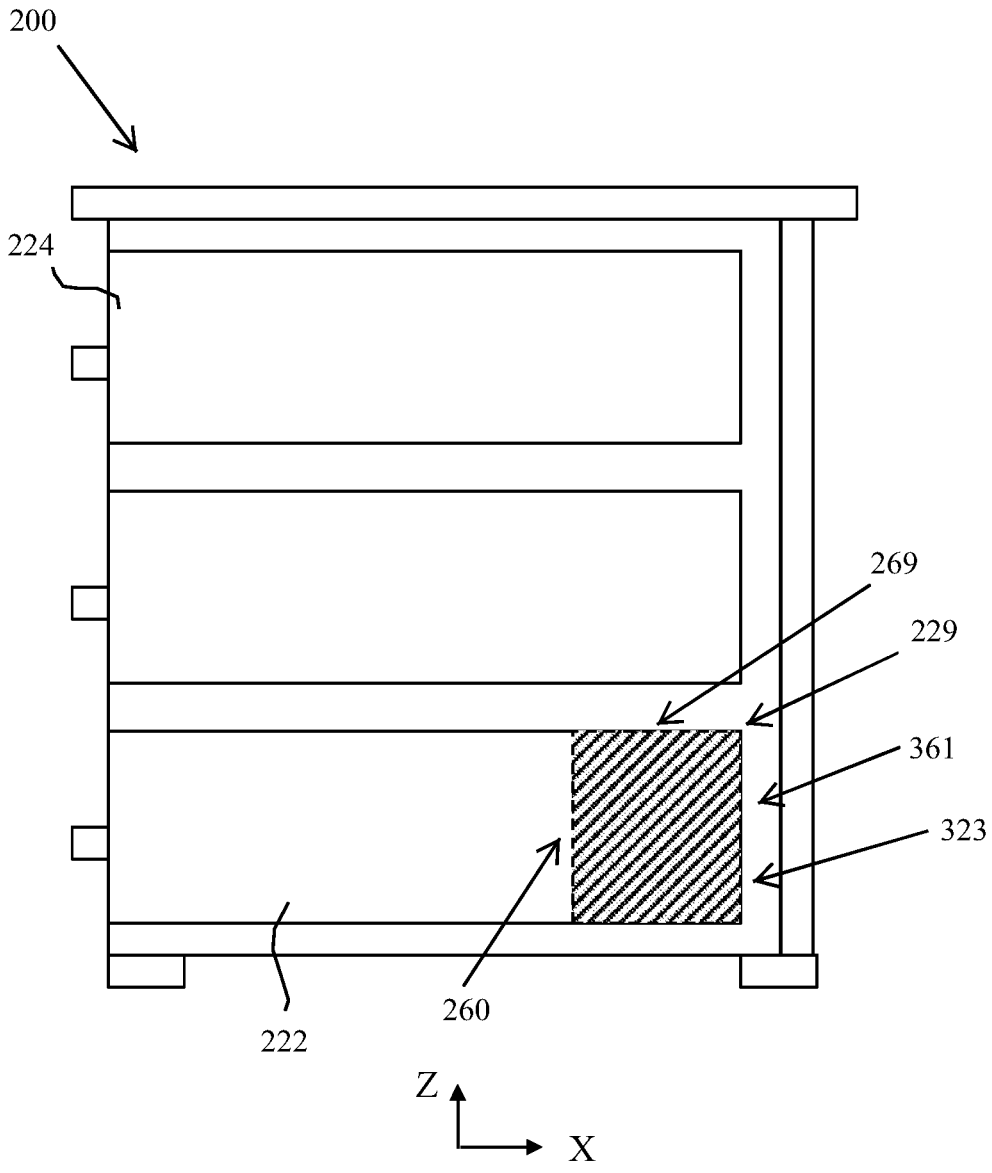
FIG. 3 is a side view of the furniture assembly of FIG. 2 with an upper drawer in a closed condition in examples of the present disclosure.

FIG. 3 is a side view of the furniture assembly 200 of FIG. 2 in examples of the present disclosure. The upper drawer 224 is in a closed condition. The plurality of pouches 260 are disposed at a rear portion of the lower drawer 222. In examples of the present disclosure, a rear wall 361 of the plurality of pouches 260 directly contacts a rear wall 323 of the lower drawer 222. A top surface 269 of each of the plurality of pouches 260 and a top surface 229 of a rear wall of the lower drawer 222 are coplanar.

Figure 4:
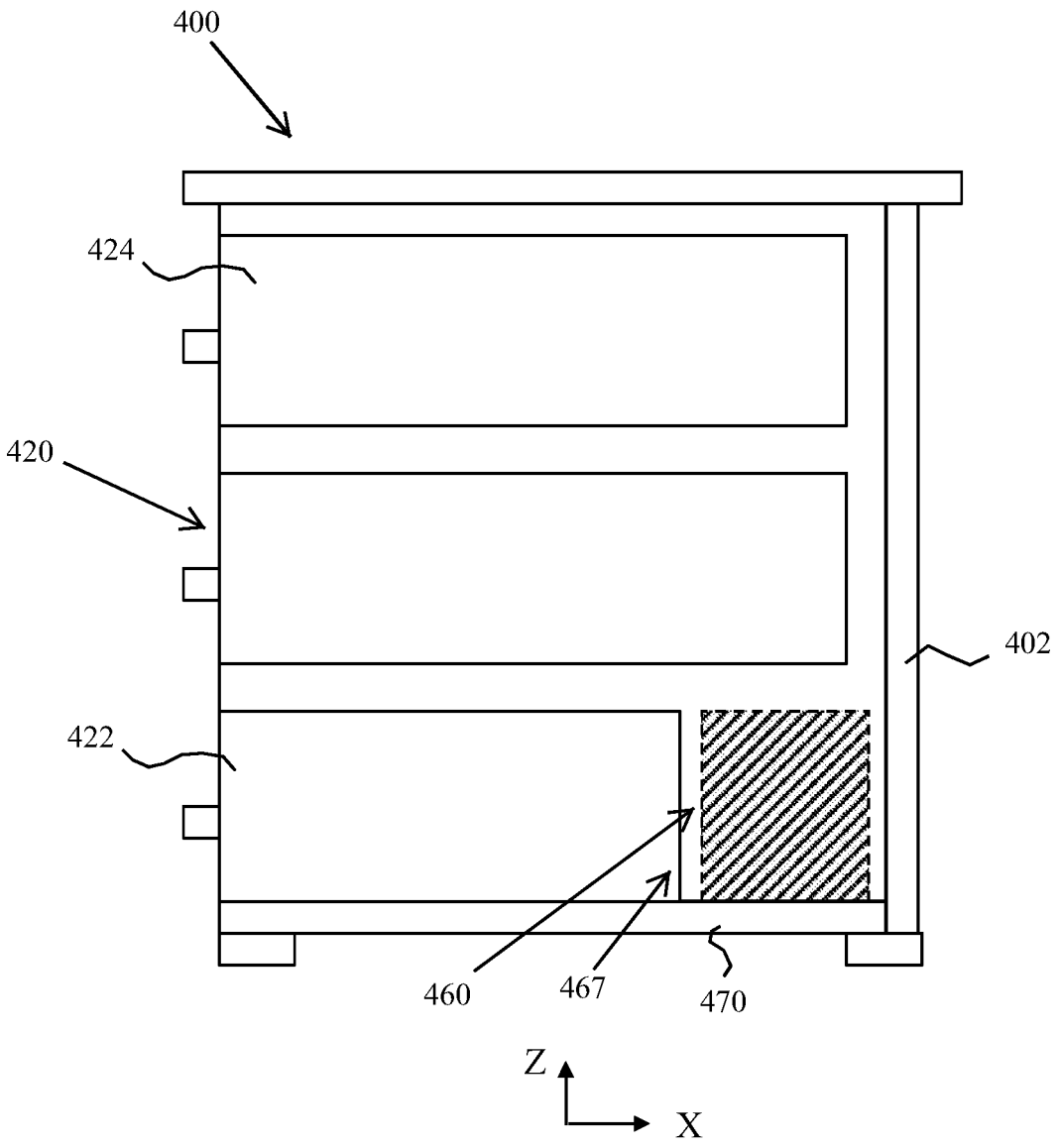
FIG. 4 is a side view of another furniture assembly in examples of the present disclosure.

FIG. 4 is a side view of a furniture assembly 400 in examples of the present disclosure. The furniture assembly 400 comprises two or more drawers 420, a plurality of pouches 460 and a bottom board 470. The two or more drawers 420 comprises a lower drawer 422 and an upper drawer 424. The lower drawer 422 is shorter than the upper drawer 424. The plurality of pouches 460 are disposed on the bottom board 470. The plurality of pouches 460 are between a rear wall 402 of the furniture assembly 400 and a rear wall 467 of the lower drawer 422.

Figure 5:
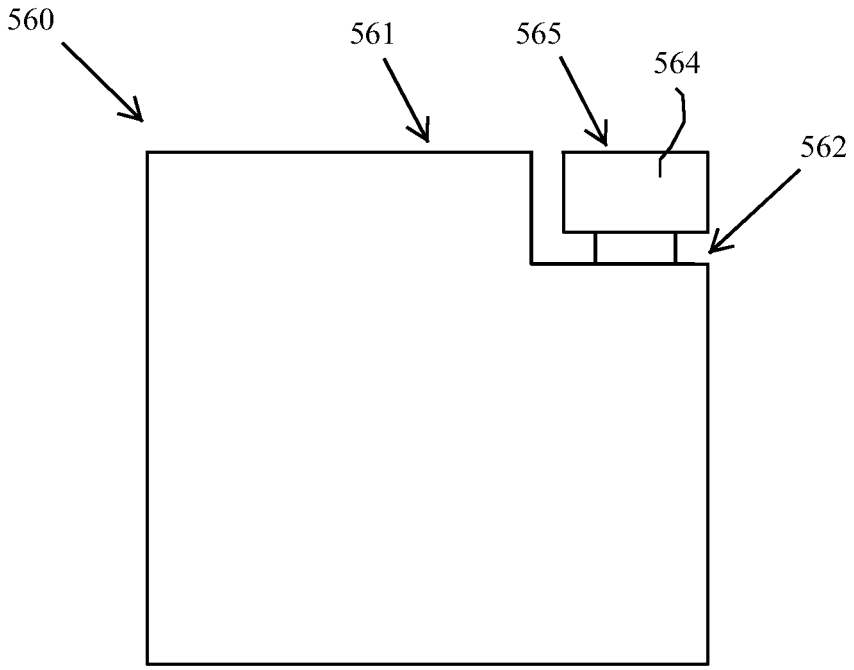
FIG. 5 is a side view of a pouch in examples of the present disclosure.

FIG. 5 is a side view of a pouch 560 in examples of the present disclosure. The pouch 560 comprises a recessed region 562. A cap 564 is positioned in the recessed region 562 of the pouch 560. A top surface 565 of the respective cap 564 and a top surface 561 of the pouch 560 are coplanar so that an internal volume of the pouch 560 is increased.

Those of ordinary skill in the art may recognize that modifications of the embodiments disclosed herein are possible. For example, a total number of the plurality of pouches 260 may vary. Other modifications may occur to those of ordinary skill in this art, and all such modifications are deemed to fall within the purview of the present invention, as defined by the claims.

The invention claimed is:

1. A furniture assembly comprising:
two or more drawers comprising:
a lower drawer; and
an upper drawer; and
a plurality of pouches disposed at a rear lower portion of the furniture assembly;
wherein the plurality of pouches are disposed at a rear portion of the lower drawer.

2. The furniture assembly of claim 1, wherein the plurality of pouches are filled with water.

3. The furniture assembly of claim 2, wherein the water contains a plurality drops of bleach.

4. The furniture assembly of claim 1, wherein a top surface of each of the plurality of pouches and a top surface of a rear wall of the lower drawer are coplanar.

5. The furniture assembly of claim 1 further comprising a bottom board.

6. The furniture assembly of claim 1, wherein each of the plurality of pouches is of a rectangular prism shape.

7. The furniture assembly of claim 1, wherein each of the plurality of pouches comprises a recessed region; wherein a respective cap is positioned in the recessed region of each of the plurality of pouches; and wherein a top surface of the respective cap and a top surface of each of plurality of pouches are coplanar.

8. The furniture assembly of claim 1, wherein the furniture assembly is a drawer dresser.

9. The furniture assembly of claim 1, wherein the furniture assembly is a drawer cabinet.

10. The furniture assembly of claim 1, wherein the plurality of pouches are filled with sand.

11. The furniture assembly of claim 1, wherein the plurality of pouches are filled with dirt.

12. A furniture assembly comprising:
two or more drawers comprising:
a lower drawer; and
an upper drawer;
a plurality of pouches disposed at a rear lower portion of the furniture assembly; and
a bottom board;
wherein the lower drawer is shorter than the upper drawer; wherein the plurality of pouches are disposed on the bottom board; and wherein the plurality of pouches are between a rear wall of the furniture assembly and a rear wall of the lower drawer.

13. A furniture assembly comprising:
two or more drawers comprising:
a lower drawer; and
an upper drawer; and
a plurality of pouches disposed at a rear lower portion of the furniture assembly;
wherein the plurality of pouches are aligned along a line; wherein each of the plurality of pouches is directly connected to a respective adjacent pouch of the plurality of pouches; and wherein a sum of a width of each of the plurality of pouches equals to a width of an internal cavity of the furniture assembly.

14. A furniture assembly comprising:
a lower drawer;
an upper drawer; and
a plurality of pouches disposed at a rear lower portion of the furniture assembly;
wherein the plurality of pouches are filled with water; and
wherein a minimum weight of the plurality of pouches is determined from torque balance.

15. The furniture assembly of claim 14, wherein the lower drawer is reinforced by a bracket.

16. A furniture assembly comprising:
a lower drawer;
an upper drawer; and
a plurality of pouches disposed at a rear lower portion of the furniture assembly;
wherein the plurality of pouches are filled with water;
wherein the water contains a plurality drops of bleach;
wherein the plurality of pouches are disposed at a rear portion of the lower drawer; and
wherein a top surface of each of the plurality of pouches and a top surface of a rear wall of the lower drawer are coplanar.

17. A furniture assembly comprising:
a lower drawer;
an upper drawer;
a plurality of pouches disposed at a rear lower portion of the furniture assembly; and
a bottom board;
wherein the plurality of pouches are filled with water;

wherein a top surface of each of the plurality of pouches and a top surface of a rear wall of the lower drawer are coplanar;

wherein the lower drawer is shorter than the upper drawer;

wherein the plurality of pouches are disposed on the bottom board; and wherein the plurality of pouches are between a rear wall of the furniture assembly and the rear wall of the lower drawer.

* * * * *